United States Patent [19]

Kanto et al.

[11] Patent Number: 4,912,084

[45] Date of Patent: Mar. 27, 1990

[54] HEAT TRANSFER SHEET

[75] Inventors: Jumpei Kanto, Komae; Hitoshi Saito, Chiba, both of Japan

[73] Assignee: Dai Nippon Insatsu Kabushiki Kaisha, Tokyo, Japan

[21] Appl. No.: 206,860

[22] PCT Filed: Oct. 7, 1987

[86] PCT No.: PCT/JP87/00754

§ 371 Date: Jun. 1, 1988

§ 102(e) Date: Jun. 1, 1988

[87] PCT Pub. No.: WO88/02699

PCT Pub. Date: Apr. 21, 1988

[30] Foreign Application Priority Data

Oct. 7, 1986 [JP] Japan ..... 61-237122
Oct. 7, 1986 [JP] Japan ..... 61-237123
Oct. 7, 1986 [JP] Japan ..... 61-237124

[51] Int. Cl.[4] ..... B41M 5/035; B41M 5/26

[52] U.S. Cl. ..... 503/227; 8/471; 428/913; 428/914

[58] Field of Search ..... 8/471; 428/913, 914; 503/227

[56] References Cited

U.S. PATENT DOCUMENTS 4,614,521 9/1986 Nina et al. ..... 8/471

FOREIGN PATENT DOCUMENTS 2161824A 1/1986 United Kingdom ..... 503/227

*Primary Examiner*—Bruce H. Hess
*Attorney, Agent, or Firm*—Arnold, White & Durkee

[57] ABSTRACT

The present invention is a dye represented by the formula (I) and/or (II) shown below, and a heat transfer sheet characterized by the use of said dye:

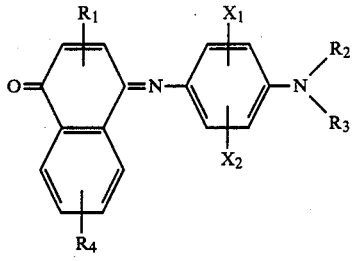

(I)

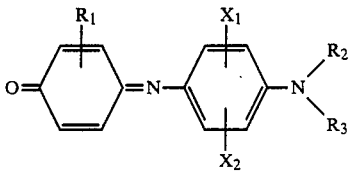

(II)

wherein each of $X_1$ and $X_2$ represents hydrogen, an alkyl group, alkoxy group, acylamino group, aminocarbonyl group or a halogen, $R_1$ or $R_4$ represents a substituent such as hydrogen, one or more alkyl groups, alkoxy groups, halogens, hydroxyl groups, amino groups, alkylamino groups, acylamino groups, sulfonylamino groups, aminocarbonyl groups, aryl groups, arylalkyl groups or nitro groups; and each $R_2$ and $R_3$ represents an alkyl group or a substituted alkyl group.

1 Claim, No Drawings

HEAT TRANSFER SHEET

TECHNICAL FIELD

This invention relates to a heat transfer sheet, more particularly to a heat transfer sheet capable of easily producing recorded images of excellent various adhesiveness to a transferable material.

BACKGROUND ART

In the prior art, various heat transfer methods have been known, and among them, there has been practiced the sublimation transfer method in which a sublimatable dye is used as the recording agent and is carried on a substrate sheet such as paper to provide a heat transfer sheet, which is superposed on a transferable material dyeable with a sublimable dye such as a fabric made of polyester. Heat energy is then imparted in a pattern from the back surface of the heat transfer sheet to cause migration of the sublimatable dye to the transferable material.

In the above sublimation transfer method, in the sublimation printing method wherein the heat transferable material is, for example, a fabric made of polyester, etc., heat energy is imparted for a relatively longer time, whereby the transferable material itself is heated by the imparted heat energy. Consequently relatively good migration of the dye can be obtained.

However, with progress in recording methods, in the case of using a thermal head, etc., and forming fine letters, figures or photographic images on, for example, transferable materials having dye receiving layers formed on polyester sheets or papers, at high speed, heat energy must be imparted within a matter of seconds or less. Therefore, since the sublimatable dye and the transferable material cannot be sufficiently heated, images with sufficient density cannot be formed.

Accordingly, in compliance with such high speed recording requirements, sublimable dyes of excellent sublimation were developed. However, dyes of excellent sublimation generally have small molecular weights, and therefore the dyes may migrate with lapse of time in the transferable material after transfer, or they may bleed out on the surface, whereby there ensue problems such as an elaborately formed image being disturbed, becoming indistinct or contaminating surrounding articles.

If sublimable dyes with relatively larger molecular weights are used in order to circumvent such problems, the sublimation speed is inferior in the high speed recording method as mentioned above. Therefore, images with satisfactory density could not be formed as described above.

Accordingly, in the heat transfer method by the use of a sublimable dye, it has been strongly desired under the present situation to develop a heat transfer sheet which can give sharp images with sufficient density and yet exhibit excellent adhesiveness of the image formed by imparting heat energy within a very short period of time as mentioned above.

DISCLOSURE OF THE INVENTION

The present inventors have studied intensivly in order to respond to the strong demand in this field of art as described above, and consequently found the following fact. That is, in the sublimation printing method of polyester fabric, etc. of the prior art, since the surface of the fabric was not smooth, the heat transfer sheet and the fabric which is the transferable material will not contact each other, and therefore the dye used therefor is essentially required to be sublimable or gasifiable (that is, the property capable of migrating through the space existing between the heat transfer sheet and the fabric). However, in the case of using a polyester sheet or surface worked paper, etc., having smooth surfaces, the heat transfer sheet and the transferable sheet sufficiently contact each other during heat transfer, and therefore not only sublimability or gasifiability of the dye is the absolutely necessary condition, but also the property of the dye migrating through the interface of the two sheets contacted with heat is extremely important. Such thermal migration at the interface was found to be greatly influenced by the chemical structure, the substituent or its position of the dye used. By selection of a dye having an appropriate molecular structure, even a dye having a molecular weight of a low value the use of which is considered to be impossible according to common sense of the prior art has been found to have good heat migratability. By the use of a heat transfer sheet carrying such a dye, it has been found that, even when the heat energy is imparted for a very short time, the dye employed can migrate easily to the transferable material to form a recorded image with high density and excellent fastness (i.e., adhesiveness). The present invention has been achieved on the basis of these findings.

More specifically, the present invention provides a dye represented by the formula (I) and/or (II) shown below and a heat transfer sheet produced by the use of the dye:

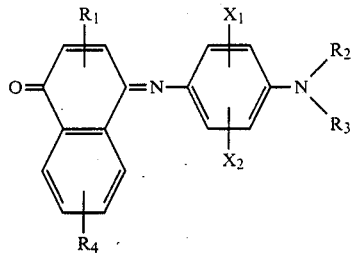

(I)

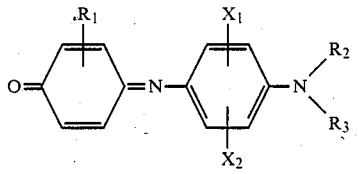

(II)

wherein $X_1$ and $X_2$ represent hydrogen, alkyl groups, alkoxy groups, acylamino groups, aminocarbonyl groups or halogens; $R_1$ or $R_4$ represents substituent such as hydrogen, one or more alkyl groups, alkoxy group, halogen, hydroxyl group, amino group, alkylamino group, acylamino group, sulfonylamino group, aminocarbonyl group, aryl group, arylalkyl group or nitro group; and $R_2$ and $R_3$ represent an alkyl group or a substituted alkyl group.

BEST MODES FOR CARRYING OUT THE INVENTION

Next, to describe in more detail the present invention, the dye represented by the above formula (I) which characterizes the present invention is obtained by the coupling method known in the art between 2,5-, 2,6 - or 3,5-disubstituted phenylenediamine compound and naphthols.

The present inventor continued detailed studies of such dyes for a adaptability as the dye for heat transfer sheet as in the present invention, and consequently found that the dye represented by the above formula (I) has excellent heating migratability even when its molecular weight is relatively greater; exhibits excellent dyeability, color forming property to a transferable material: is free from lack of migratability (bleeding) observed in the transferred transferable material, and thus has extremely ideal properties as a dye for heat transfer sheets.

DYES OF THE FORMULA (I)

The preferable dyes of the above formula (I) in the present invention are those wherein the substituents $X_1$ and $X_2$ are two electron-donating groups such as alkyl groups, alkoxy groups or halogen atoms, etc. existing at para- or meta-positions as 2,5-, 2,6- or 3,5-, particularly preferably 2,5- or 2,6-, or when one of $X_1$ or $X_2$ is a hydrogen atom, the other should preferably exist at the meta-position relative to the dialkylamino group [(-$N(R_4)(R_5)$]. $R_1$ is preferably an electron-withdrawing group, and by the presence of such group, a blue dye with deeper hue together with high light resistance and migration resistance can be obtained.

$R_4$ may be a hydrogen atom or otherwise a substituent as described above.

Also, with respect to $R_2$ and $R_3$, those wherein both are $C_1$–$C_{10}$ alkyl groups, and at least one of $R_2$ and $R_3$ has a polar group such as a hydroxyl group or substituted hydroxyl group, amino group or substituted amino group, cyano group, etc. were found to give the best results, that is, having excellent heat migratability, dyeability to transferable material, heat resistance during transfer, excellent migration resistance after transfer simultaneously with color forming characteristic.

Specific examples of preferable dyes in the above formula (I) are shown below. The following Table 1-A shows the substituents $R_1$, $R_2$, and $R_3$ and $X_1$ and $X_2$.

TABLE 1-A

| No. | $R_1$ | $X_1$ | $X_2$ | $R_2$ | $R_3$ |
|---|---|---|---|---|---|
| 1 | H | H | $CH_3$ | $C_2H_5$ | $C_2H_4OH$ |
| 2 | H | H | H | $C_2H_5$ | $C_2H_4OH$ |
| 3 | H | $CH_3$ | $OCH_3$ | $C_2H_5$ | $C_2H_4OH$ |
| 4 | H | H | Cl | $C_2H_5$ | $C_2H_4OH$ |
| 5 | H | $OCH_3$ | H | $C_2H_5$ | $C_2H_4OH$ |
| 6 | H | H | H | $C_2H_5$ | $C_2H_4NHSO_2CH_3$ |
| 7 | $CONHC_4H_9$ | H | Br | $CH_3$ | $CH_3$ |
| 8 | $CONHC_4H_9$ | H | $CH_3$ | $C_2H_5$ | $C_2H_4OH$ |
| 9 | $CONHC_3H_7$ | $CH_3$ | H | $C_2H_4CN$ | $C_2H_5$ |
| 10 | $CONHCH_3$ | H | H | $CH_3$ | $CH_3$ |
| 11 | H | $CH_3$ | $CH_3$ | $C_8H_{17}$ | $C_8H_{17}$ |
| 12 | $CH_3$ | $CH_3$ | Cl | $C_2H_5$ | $C_2H_4OH$ |
| 13 | $OCH_3$ | Cl | Cl | $C_2H_5$ | $C_2H_5$ |
| 14 | Cl | H | $OC_2H_5$ | $C_2H_5$ | $C_2H_4OH$ |
| 15 | $CONH_2$ | $OC_2H_5$ | $OC_2H_5$ | $CH_3$ | $C_2H_4OH$ |

Particularly, good cyan dyes are obtained when $R_1$ is an alkylaminocarbonyl group or an acylamino group in the 2-position.

(A) In the dyes of the formula (I), those wherein $X_1$, $X_2$, $R_1$–$R_3$ are (1) to (15) as mentioned above, and $R_4$=5-, 6-, 7- or 8-$OCH_3$;

(B) In the dyes of the formula (I), those wherein $X_1$, $X_2$, $R_1$–$R_3$ are (1) to (15) as mentioned above, and $R_4$=5-, 6-, 7- or 8-OH;

(C) In the dyes of the formula (I), those wherein $X_1$, $X_2$, $R_1$–$R_3$ are (1) to (15) as mentioned above, and $R_4$=5-, 6-, 7- or 8-$NH_2$;

(D) In the dyes of the formula (I), those wherein $X_1$, $X_2$, $R_1$–$R_3$ are (1) to (15) as mentioned above, and $R_4$=5-, 6-, 7- or 8-$NHC_2H_5$;

(E) In the dyes of the formula (I), those wherein $X_1$, $X_2$, $R_1$–$R_3$ are (1) to (15) as mentioned above, and $R_4$=5-, 6-, 7- or 8-$NHCO_3H_7$;

(F) In the dyes of the formula (I), those wherein $X_1$, $X_2$, $R_1$–$R_3$ are (1) to (15) as mentioned above, and $R_4$=5-, 6-, 7- or 8-$NHSO_2$-ph-$CH_3$;

(G) In the dyes of the formula (I), those wherein $X_1$, $X_2$, $R_1$–$R_3$ are (1) to (15) as mentioned above, and $R_4$=5-, 6-, 7- or 8-$NO_2$;

(H) In the dyes of the formula (I), those wherein $X_1$, $X_2$, $R_1$–$R_3$ are (1) to (15) as mentioned above, and $R_4$=5-, 6-, 7- or 8-Cl;

(I) In the dyes of the formula (I), those wherein $X_1$, $X_2$, $R_1$–$R_3$ are (1) to (15) as mentioned above, and $R_4$=5-, 6-, 7- or 8-$CH_3$ or -$C_2H_5$;

(J) In the dyes of the formula (I), those wherein $X_1$, $X_2$, $R_1$–$R_3$ are (1) to (15) as mentioned above, and $R_4$=5-, 6-, 7- or 8-$OCH_3$;

(K) In the dyes of the formula (I), those wherein $X_1$, $X_2$, $R_1$–$R_3$ are (1) to (15) as mentioned above, and $R_4$=5-, 8-di-$OCH_5$;

(L) In the dyes of the formula (I), those wherein $X_1$, $X_2$, $R_1$–$R_3$ are (1) to (15) as mentioned above, and $R_4$=5-, 8-di-$OCH_3$ or $CH_3$;

(M) In the dyes of the formula (I), those wherein $X_1$, $X_2$, $R_1$–$R_3$ are (1) to (15) as mentioned above, and $R_4$=5-, 8-di-Cl;

(N) In the dyes of the formula (I), those wherein $X_1$, $X_2$, $R_1$–$R_3$ are (1) to (15) as mentioned above, and $R_4$=5-, 6-, 7- or 8-Br; and (O) In the dyes of the formula (I), those wherein $X_1$, $X_2$, $R_1$–$R_3$ are (1) to (15) as mentioned above, and $R_4$=5-, 6-, 7- or 8-$CONHC_4H_9$.

Further, specific examples of preferable dyes in the above formula (I) are shown below. The following Table 1-B shows substituents $R_1$ to $R_4$ in the formula (I).

TABLE 1-B

| No. | $R_1$ | $R_4$ | $R_2$ | $R_3$ |
|---|---|---|---|---|
| 1 | H | $OCH_3$ | $C_2H_5$ | $C_2H_4OH$ |
| 2 | H | OH | $C_2H_5$ | $C_2H_4OH$ |
| 3 | H | $NH_2$ | $C_2H_5$ | $C_2H_4OH$ |
| 4 | H | $NHC_2H_5$ | $C_2H_5$ | $C_2H_4OH$ |
| 5 | H | $NHCOC_3H_7$ | $C_2H_5$ | $C_2H_4OH$ |
| 6 | H | $NO_2$ | $C_2H_5$ | $C_2H_4NHSO_2CH_3$ |

TABLE 1-B-continued

| No. | $R_1$ | $R_4$ | $R_2$ | $R_3$ |
|---|---|---|---|---|
| 7 | $CONHC_4H_9$ | H | $CH_3$ | $CH_3$ |
| 8 | $CONHC_4H_9$ | H | $C_2H_5$ | $C_2H_4OH$ |
| 9 | $CONHC_3H_7$ | H | $C_2H_5$ | $C_2H_4CN$ |
| 10 | $CONHCH_3$ | H | $CH_3$ | $CH_3$ |
| 11 | H | $CH_3$ | $C_8H_{17}$ | $C_8H_{17}$ |
| 12 | $CH_3$ | $(CH_3)_2$ | $C_2H_5$ | $C_2H_4OH$ |
| 13 | $OCH_3$ | $(OCH_3)_2$ | $C_2H_5$ | $C_2H_5$ |
| 14 | Cl | H | $C_2H_5$ | $C_2H_4OH$ |
| 15 | $CONH_2$ | $OC_2H_5$ | $CH_3$ | $C_2H_4OH$ |
| 16 | $CONHCH_3$ | $CONHCH_3$ | $C_2H_5$ | $C_2H_4OH$ |

Particularly good cyan dyes are obtained when an aminocarbonyl group or an acylamino group exists at the 2'-position in the formula (I).

(A) In the dyes of the formula (I), those wherein $R_1$–$R_4$ are (1)–(16) as mentioned above, and $X_1$ and $X_2$ are 2,5-di-$CH_3$;

(B) In the dyes of the formula (I), those wherein $R_1$–$R_4$ are (1)–(16) as mentioned above, and $X_1$ and $X_2$ are 2,5-di-$OCH_3$;

(C) In the dyes of the formula (I), those wherein $R_1$–$R_4$ are (1)–(16) as mentioned above, and $X_1$ and $X_2$ are 2,5-di-$C_2H_5$;

(D) In the dyes of the formula (I), those wherein $R_1$–$R_4$ are (1)–(16) as mentioned above, and $X_1$ and $X_2$ are 2,5-di-$OC_2H_5$;

(E) In the dyes of the formula (I), those wherein $R_1$–$R_4$ are (1)–(16) as mentioned above, and $X_1$ and $X_2$ are 2,5-di-Cl;

(F) In the dyes of the formula (I), those wherein $R_1$–$R_4$ are (1)–(16) as mentioned above, and $X_1$ and $X_2$ are 2-$CH_3$ and 5-$OCH_3$;

(G) In the dyes of the formula (I), those wherein $R_1$–$R_4$ are (1)–(16) as mentioned above, and $X_1$ and $X_2$ are 2-$CH_3$ and 5-Br;

(H) In the dyes of the formula (I), those wherein $R_1$–$R_4$ are (1)–(16) as mentioned above, and $X_1$ and $X_2$ are 2-Cl and 5-$OCH_3$;

(I) In the dyes of the formula (I), those wherein $R_1$–$R_4$ are (1)–(16) as mentioned above, and $X_1$ and $X_2$ are 2-Cl and 5-$OC_2H_5$;

(J) In the dyes of the formula (I), those wherein $R_1$–$R_4$ are (1)–(16) as mentioned above, and $X_1$ and $X_2$ are 2,6-di-Cl;

(K) In the dyes of the formula (I), those wherein $R_1$–$R_4$ are (1)–(16) as mentioned above, and $X_1$ and $X_2$ are 2,6-di-$CH_3$;

(L) In the dyes of the formula (I), those wherein $R_1$–$R_4$ are (1)–(16) as mentioned above, and $X_1$ and $X_2$ are 2,6-di-$OCH_3$;

(M) In the dyes of the formula (I), those wherein $R_1$–$R_4$ are (1)–(16) as mentioned above, and $X_1$ and $X_2$ are 2,6-di-$C_2H_5$; and (N) In the dyes of the formula (I), those wherein $R_1$–$R_4$ are (1)–(16) as mentioned above, and $X_1$ and $X_2$ are 2,6-di-$OC_2H_5$.

DYES OF THE FORMULA (II)

The preferable dyes of the above formula (II) in the present invention are those wherein the substituents $X_1$ and $X_2$ are two electron-donating groups such as alkyl groups, alkoxy groups or halogen atoms, etc. existing at para- or meta-positions as 2,5-, 2,6- or 3,5-, particularly preferably 2,5- or 2,6-, and $R_1$ is an electron-withdrawing group, and by the presence of such group, a blue dye with deeper hue together with high light resistance and migration resistance can be obtained.

Also, with respect to $R_2$ and $R_3$, those wherein both are $C_1$–$C_{10}$ alkyl groups, and at least one of $R_2$ and $R_3$ has a polar group such as hydroxyl group or substituted hydroxyl group, amino group or substituted amino group, cyano group, etc. were found to give the best results, that is, having excellent heat migratability and dyeability relative to the transferable material, heat resistance during transfer, and excellent migration resistance after transfer simultaneously with excellent color forming characteristics.

Specific examples of preferable dyes in the above formula (II) are shown below. The following Table 1-C shows the substituents $R_1$, $R_2$, and $R_3$.

TABLE 1-C

| No. | $R_1$ | $R_2$ | $R_3$ |
|---|---|---|---|
| 1 | H | $C_2H_5$ | $C_2H_4OH$ |
| 2 | Cl | $C_2H_5$ | $C_2H_4OH$ |
| 3 | $CH_3$ | $C_2H_5$ | $C_2H_4OH$ |
| 4 | $OCH_3$ | $C_2H_5$ | $C_2H_4NHSO_2CH_3$ |
| 5 | $NHCOC_4H_9$ | $CH_3$ | $CH_3$ |
| 6 | $NHCOC_4H_9$ | $C_2H_5$ | $C_2H_4OH$ |
| 7 | $NHCOC_3H_7$ | $C_2H_5$ | $C_2H_4CN$ |
| 8 | $NHCOCH_3$ | $CH_3$ | $CH_3$ |
| 9 | ph | $C_8H_{17}$ | $C_8H_{17}$ |
| 10 | $C_2H_5$ | $C_2H_5$ | $C_2H_4OH$ |
| 11 | $OC_2H_5$ | $C_2H_5$ | $C_2H_5$ |
| 12 | Br | $C_2H_5$ | $C_2H_4OH$ |
| 13 | $CONHCH_3$ | $CH_3$ | $C_2H_4OH$ |

Particularly, good cyan dyes are obtained when $R_1$ exists at the 2'-position and $R_1$ is an alkylaminocarbonyl group or an acylamino group.

(A) In the dyes of the formula (II), those wherein $R_1$–$R_3$ are (1)–(13) as mentioned above, and $X_1$ and $X_2$ are 2,5-di-$CH_3$;

(B) In the dyes of the formula (II), those wherein $R_1$–$R_3$ are (1)–(13) as mentioned above, and $X_1$ and $X_2$ are 2,5-di-$OCH_3$;

(C) In the dyes of the formula (II), those wherein $R_1$–$R_3$ are (1)–(13) as mentioned above, and $X_1$ and $X_2$ are 2,5-di-$C_2H_5$;

(D) In the dyes of the formula (II), those wherein $R_1$–$R_3$ are (1)–(13) as mentioned above, and $X_1$ and $X_2$ are 2,5-di-$OC_2H_5$;

(E) In the dyes of the formula (II), those wherein $R_1$–$R_3$ are (1)–(13) as mentioned above, and $X_1$ and $X_2$ are 2,5-di-Cl;

(F) In the dyes of the formula (II), those wherein $R_1$–$R_3$ are (1)–(13) as mentioned above, and $X_1$ and $X_2$ are 2-$CH_3$ and 5-$OCH_3$;

(G) In the dyes of the formula (II), those wherein $R_1$–$R_3$ are (1)–(13) as mentioned above, and $X_1$ and $X_2$ are 2-$CH_3$ and 5-Br;

(H) In the dyes of the formula (II), those wherein $R_1$–$R_3$ are (1)–(13) as mentioned above, and $X_1$ and $X_2$ are 2-Cl and 5-$OCH_3$;

(I) In the dyes of the formula (II), those wherein $R_1$–$R_3$ are (1)–(13) as mentioned above, and $X_1$ and $X_2$ are 2-Cl and 5-$OC_2H_5$;

(J) In the dyes of the formula (II), those wherein $R_1$–$R_3$ are (1)–(13) as mentioned above, and $X_1$ and $X_2$ are 2,6-di-Cl;

(K) In the dyes of the formula (II), those wherein $R_1$–$R_3$ are (1)–(13) as mentioned above, and $X_1$ and $X_2$ are 2,6-di-$CH_3$;

(L) In the dyes of the formula (II), those wherein $R_1$–$R_3$ are (1)–(13) as mentioned above, and $X_1$ and $X_2$ are 2,6-di-$OCH_3$;

(M) In the dyes of the formula (II), those wherein $R_1$–$R_3$ are (1)–(13) as mentioned above, and $X_1$ and $X_2$ are 2,6-di-$C_2H_5$; and (N) In the dyes of the formula (II), those wherein $R_1$–$R_3$ are (1)–(13) as mentioned above, and $X_1$ and $X_2$ are 2,6-di-$OC_2H_5$.

HEAT TRANSFER SHEET

The heat transfer sheet of the present invention is characterized by the use of a specific dye as described above, and other constitutions may be the same as those of the heat transfer sheet known in the art.

The substrate sheet to be used for constituting the heat transfer sheet of the present invention containing the above dye may be any material known in the art having heat resistance and strength to some extent, including, for example, papers, various converted papers, polyester films, polystyrene films, polypropylene films, polysulfone films, polycarbonate films, polyvinyl alcohol films, and cellophanes, particularly preferably polyester films, having a thickness of 0.5 to 50 μm, preferably about 3 to 10 μm.

The dye carrying layer to be provided on such a substrate sheet as described above is a layer having the dye of the above formula (I) and/or the (II) carried with any desired binder resin.

As the binder resin for carrying the above dye, all of those known in the art can be used. Preferable examples are cellulose type resins such as ethyl cellulose, hydroxyethyl cellulose, ethyl hydroxycellulose, hydroxypropyl cellulose, methyl cellulose, cellulose acetate, and cellulose acetate butyrate; vinyl type resins such as polyvinyl alcohol, polyvinyl acetate, polyvinyl butyral, polyvinyl acetal, polyvinyl pyrrolidone, and polyacrylamide. Among these, particularly polyvinyl butyral and polyvinyl acetal are preferred for their heat resistance, migratability of dye, and other desirable properties.

The dye carrying layer of the heat transfer sheet of the present invention is formed basically of the above materials, but it can otherwise also include various additives similarly as is known in the art, if necessary.

Such a dye carrying layer is preferably formed by adding the above dyes, the binder resin and other optional components in an appropriate solvent to cause the respective components to be dissolved or dispersed to prepare a coating liquid or ink for formation of the carrying layer, applying this on the above substrate sheet, and by drying the same.

The carrying layer thus formed has a thickness of 0.2 to 5.0 μm, preferably about 0.4 to 2.0 μm, and the above dye in the carrying layer should be suitably present in an amount of 5 to 70% by weight, preferably 10 to 60% by weight based on the weight of the carrying layer.

The heat transfer sheet of the present invention as described above is amply useful as it is for heat transfer, but further a sticking prevention layer, namely, a mold release layer, may be also provided on the surface of the dye carrying layer. By the provision of such a layer, sticking between the heat transfer sheet and the transferable material during heat transfer can be prevented, and by the use of a still higher heat transfer temperature, an image with further excellent density can be formed.

As the mold release layer, considerable effect can be exhibited merely by applying an inorganic powder for tackiness prevention, and further it can be formed by, for example, providing a mold release layer of 0.01 to 5 μm, preferably 0.05 to 2 μm of a resin of excellent mold release property such as silicone polymer, acrylic polymer, and fluorinated polymer.

The inorganic powder or the mold releasable polymer as mentioned above can be also included in the dye carrying layer to exhibit ample effect.

Further, a heat resistant layer may be also provided on the back surface of such heat transfer sheet for preventing deleterious influences from the heat of the thermal head.

The transferable sheet to be used for formation of an image by the use of such a heat transfer sheet as described above may be any transferable sheet provided that its recording surface has dye receptivity to the above dye. Also in the case of paper, metal, glass, synthetic resin, etc. having no dye receptivity, a dye receiving layer may be formed on at least one surface thereof.

Examples of the transferable material on which no dye receiving layer is required are fibers, fabrics, films, sheets, molded products comprising polyolefinic resins such as polyethylene and polypropylene; halogenated polymers such as polyvinyl chloride, and polyvinylidene chloride; vinyl polymers such as polyvinyl alcohol, polyvinyl acetate, and polyacrylates; polyester resins such as polyethylene terephthalate and polybutylene terephthalate; polystyrene resins; polyamide resins; copolymer resins of olefins such as ethylene and propylene, with other vinyl monomers; ionomers; cellulose resins such as cellulose diacetate and cellulose triacetate; polycarbonates; polysulfones; and polyimides.

Particularly preferred are sheets or films comprising polyester or converted papers having polyester layers provided thereon. Also, even a non-dyeable transferable material such as paper, metal, and glass can be used as the transferable material by coating and drying a solution or dispersion of the dyeable resin as mentioned above on the recording surface, or laminating those resin films thereon.

Further, even the above transferable material having dyeability may also have a dye receiving layer as in the case of paper as described above of a resin with better dyeability formed on the surface thereof.

The dye receiving layer thus formed may be formed of a single material or a plurality of materials, and also various additives may be included within a range which does not obstruct the intended purpose.

Such dye receiving layer may have any desired thickness, but generally a thickness of 5 to 50 μm is used. Also, such a dye receiving layer is preferably a continuous coating, but it can also be formed as discontinuous coating by the use of a resin emulsion or a resin dispersion.

Such a transferable material is basically as described above and can be amply used as it is, but an inorganic powder for prevention of sticking can be included in the above transferable material or its dye receiving layer, and by doing so, sticking between the heat transfer sheet and the transferable material can be prevented to afford further excellent heat transfer. Particularly preferred is fine powdery silica.

Also, in place of an inorganic powder such as the above silica, or in combination therewith, the resin as described above with good release property may be also added. A particularly preferable mold releasable polymer is a cured product of a silicone compound, for example, a cured product comprising an epoxy modified silicone oil and an amino-modified silicone oil. Such a mold release agent is added preferably in a quantity of about 0.5 to 30% by weight of the dye receiving layer.

Furthermore, the transferable material to be used may be coated with an inorganic powder as mentioned above on its dye receiving layer and also provided with a layer comprising a mold release agent of excellent mold release property as described above.

Such a mold release layer exhibits ample effect with a thickness of about 0.01 to 0.5 μm and can improve further dye receptivity while preventing sticking between the heat transfer sheet and the dye receiving layer.

As the means for imparting heat energy to be used in carrying out heat transfer by the use of the heat transfer sheet of the present invention and the recording medium as described above, any of the means known in the art can be used. For example, by means of a recording device such as a thermal printer (for example, Thermal Printer TN-5400, produced by Toshiba K.K.), the intended purpose can be fully accomplished by imparting heat energy of about 5 to 100 mJ/mm$^2$ by control of the recording time.

FUNCTION AND ADVANTAGE

According to the present invention as described above, as already partially explained, the dyes of the above formulae (I) and (II) used in constituting the heat transfer sheet of the present invention, in spite of having remarkably higher molecular weights as compared with sublimating dyes which have been used in the heat transfer sheet of the prior art (molecular weights about 150 to 250), because of having specific structures and substituents at specific positions, exhibit excellent heating migratability, dyeability to transferable material and color forming characteristic, and also without migration into the transferable material or bleed-out on the surface after transfer.

Accordingly, the image formed by the use of the heat transfer sheet of the present invention has excellent adhesion, particularly migration resistance and contamination resistance and therefore is completely free from impairment of sharpness of the image formed or contamination of articles whereby various problems of the prior art have been solved.

Particularly, in the case of a dye wherein at least one of $R_1$ to $R_4$ in the formula (I) and $R_1$, $R_2$ and $R_3$ is a polar group, fastness as described above becomes further marked. Such an excellent effect which was not conceivable in the prior art can appear remarkably, particularly when the dye receiving portion of the transferable material is a material such as a polyester. This may be considered to be due to fixing of the dye having a polar group by some action in the polyester through correlation with the ester bond which is the polar group in the polyester.

The present invention will now be described in more detail by way of the following Examples and Comparative Examples, in which quantities expressed in parts or % are based on weight unless otherwise specifically noted.

EXAMPLE A-1

1.75 parts of a compound represented by the following structural formula:

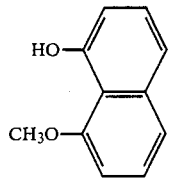

was dissolved in 200 parts of 95% ethanol, and to the resultant solution was added an aqueous solution of 5 parts of anhydrous sodium carbonate dissolved in 50 parts of water to make a mixed solution.

Next, a sulfate hydrate of a compound represented by the following structural formula:

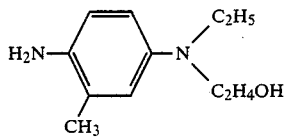

in an amount of 2.1 parts as calculated on the basis of the compound of the structural formula was dissolved in 50 parts of water, and the resultant solution was added to the above mixed solution. After the mixture was thoroughly mixed, 12.5 parts of sodium hypochlorite solution was added gradually thereto. The mixture was stirred in this state for 15 minutes, filtered and washed with pure water. When the filtrate became neutral, it was dried, and the product was dissolved in ethyl acetate and subjected to column purification by using ethyl acetate/heptane to obtain a dye of the following structural formula [(A)-(1) in the above Table 1-A].

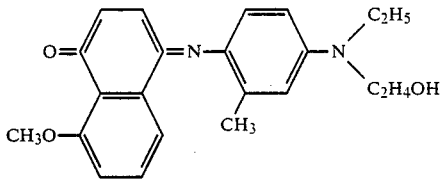

EXAMPLE A-2

According to the same method as in Example A-1, the example dyes in the above Table 1-A were obtained by varying the respective starting materials.

EXAMPLE A-3

An ink composition for formation of a dye carrying layer of the following composition was prepared and applied on a polyester terephthalate film with a thickness of 9 μm, the back surface of which had been subjected to a heat-resistant treatment, to a dried coating amount of 1.0 g/m$^2$. The coating was dried to obtain a heat transfer sheet of the present invention.

| | |
|---|---|
| Dye in the above Table 1 | 3 parts |
| Polyvinylbutyral resin | 4.5 parts |
| Methyl ethyl ketone | 46.25 parts |
| Toluene | 46.25 parts |

Next, by the use of a synthetic paper (Yupo FPG #150, produced by Oji Yuka), a coating liquid of the following composition was applied in a proportion of 10.0 g/m$^2$ on drying and dried at 100° C. for 30 minutes to obtain a transferable material.

| | |
|---|---|
| Polyester resin (Vylon 200, produced by Toyobo) | 11.5 parts |
| Vinyl chloride-vinyl acetate copolymer (VYHH, produced by UCC) | 5.0 parts |
| Amino-modified silicone (KF-393, produced by Shinetsu Kagaku Kogyo) | 1.2 parts |
| Epoxy-modified silicone (X-22-343, produced by Shinetsu Kagaku Kogyo) | 1.2 parts |
| Methyl ethyl ketone/toluene/cyclohexanone (weight ratio 4:4:2) | 102.0 parts |

The above heat transfer sheet of the present invention and the above transferable sheet were superposed on one another with the respective dye carrying layer and the dye receiving layer facing each other, and recording was performed with a thermal head from the back surface of the heat transfer sheet under the conditions of an application voltage of 10 V and a printing time of 4.0 msec. to obtain the results shown below in Table 3.

COMPARATIVE EXAMPLE A

By the use of the dye in Table 3 shown below as the dye in Example A-3, and following otherwise the same procedure as in Example A-4, the results shown in Table 3 below were obtained. However, the ink composition for formation of dye carrying layer was made as shown below.

| | |
|---|---|
| Dye in Table 3-A shown below | 3 parts |
| Polyvinylbutyral resin | 4.5 parts |
| Methyl ethyl ketone | 46.25 parts |
| Toluene | 46.25 parts |

TABLE 2-A

| Dye | Color forming density | Fastness | Tone | Molecular weight |
|---|---|---|---|---|
| (A)-(1) | 1.64 | | indigo | 380 |
| (A)-(2) | 1.71 | | indigo | 360 |
| (A)-(3) | 1.47 | | indigo | 410 |
| (A)-(4) | 1.49 | | indigo | 400.5 |
| (A)-(5) | 1.50 | | indigo | 396 |
| (A)-(6) | 1.42 | | indigo | 443 |
| (A)-(7) | 1.47 | | indigo | 398.9 |
| (A)-(8) | 1.25 | | indigo | 479 |
| (A)-(9) | 1.26 | | indigo | 474 |
| (A)-(12) | 1.43 | | indigo | 428.5 |
| (A)-(13) | 1.37 | | indigo | 449 |
| (A)-(14) | 1.39 | | indigo | 444.5 |
| (B)-(1) | 1.72 | | indigo | 366 |
| (B)-(2) | 1.74 | | indigo | 352 |
| (B)-(4) | 1.57 | | indigo | 386.5 |
| (B)-(5) | 1.64 | | indigo | 382 |
| (B)-(7) | 1.64 | | indigo | 384.9 |
| (B)-(8) | 1.44 | | indigo | 465 |
| (B)-(9) | 1.32 | | indigo | 460 |
| (B)-(10) | 1.70 | | indigo | 371 |
| (B)-(13) | 1.45 | | indigo | 435 |
| (B)-(15) | 1.34 | | indigo | 469 |
| (C)-(1) | 1.71 | | indigo | 365 |
| (C)-(2) | 1.74 | | indigo | 351 |
| (C)-(4) | 1.53 | | indigo | 385.5 |
| (C)-(5) | 1.64 | | indigo | 381 |
| (C)-(7) | 1.63 | | indigo | 383.9 |
| (C)-(8) | 1.42 | | indigo | 464 |
| (C)-(9) | 1.32 | | indigo | 459 |
| (C)-(10) | 1.71 | | indigo | 370 |
| (C)-(13) | 1.45 | | indigo | 434 |
| (D)-(1) | 1.54 | | indigo | 393 |

TABLE 2-A-continued

| Dye | Color forming density | Fastness | Tone | Molecular weight |
|---|---|---|---|---|
| (D)-(5) | 1.47 | | indigo | 409 |
| (D)-(10) | 1.49 | | indigo | 398 |
| (D)-(14) | 1.27 | | indigo | 457.5 |
| (E)-(2) | 1.42 | | indigo | 421 |
| (E)-(3) | 1.23 | | indigo | 465 |
| (E)-(4) | 1.29 | | indigo | 455.5 |
| (E)-(6) | 1.13 | | indigo | 498 |
| (E)-(7) | 1.32 | | indigo | 453.9 |
| (E)-(8) | 1.10 | | indigo | 534 |
| (E)-(9) | 0.97 | | indigo | 529 |
| (E)-(12) | 1.14 | | indigo | 483.5 |
| (E)-(13) | 1.11 | | indigo | 504 |
| (F)-(1) | 1.03 | | indigo | 519 |
| (F)-(2) | 1.10 | | indigo | 505 |
| (F)-(3) | 0.98 | | indigo | 535 |
| (F)-(4) | 0.93 | | indigo | 539.5 |
| (F)-(5) | 0.97 | | indigo | 535 |
| (F)-(6) | 0.72 | | indigo | 582 |
| (F)-(7) | 0.98 | | indigo | 537.9 |
| (F)-(8) | 0.40 | | indigo | 770 |
| (F)-(9) | 0.62 | | indigo | 613 |
| (F)-(12) | 0.83 | | indigo | 567.5 |
| (F)-(13) | 0.82 | | indigo | 588 |
| (F)-(15) | 0.62 | | indigo | 622 |
| (G)-(1) | 1.53 | | indigo | 395 |
| (G)-(2) | 1.64 | | indigo | 381 |
| (G)-(3) | 1.43 | | indigo | 425 |
| (G)-(4) | 1.44 | | indigo | 415.5 |
| (G)-(5) | 1.47 | | indigo | 411 |
| (G)-(6) | 1.29 | | indigo | 458 |
| (G)-(7) | 1.46 | | indigo | 413.9 |
| (G)-(8) | 1.25 | | indigo | 494 |
| (G)-(9) | 1.13 | | indigo | 489 |
| (G)-(12) | 1.42 | | indigo | 443.5 |
| (G)-(13) | 1.26 | | indigo | 464 |
| (H)-(1) | 1.64 | | indigo | 384.5 |
| (H)-(2) | 1.71 | | indigo | 370.5 |
| (H)-(4) | 1.48 | | indigo | 405 |
| (H)-(5) | 1.49 | | indigo | 400.5 |
| (H)-(7) | 1.49 | | indigo | 403.4 |
| (H)-(8) | 1.27 | | indigo | 483.5 |
| (H)-(9) | 1.17 | | indigo | 478.5 |
| (H)-(12) | 1.45 | | indigo | 433 |
| (H)-(13) | 1.32 | | indigo | 453.5 |
| (I)-(1) | 1.64 | | indigo | 364 |
| (I)-(5) | 1.64 | | indigo | 380 |
| (I)-(10) | 1.71 | | indigo | 369 |
| (I)-(14) | 1.43 | | indigo | 428 |
| (J)-(1) | 1.47 | | indigo | 411 |
| (J)-(5) | 1.53 | | indigo | 427 |
| (J)-(10) | 1.42 | | indigo | 416 |
| (J)-(14) | 1.20 | | indigo | 475.5 |
| (K)-(1) | 1.41 | | indigo | 447 |
| (K)-(5) | 1.29 | | indigo | 463 |
| (K)-(10) | 1.32 | | indigo | 452 |
| (K)-(14) | 1.13 | | indigo | 511.5 |
| (L)-(1) | 1.42 | | indigo | 426 |
| (L)-(5) | 1.41 | | indigo | 442 |
| (L)-(10) | 1.45 | | indigo | 431 |
| (L)-(14) | 1.13 | | indigo | 490.5 |
| (M)-(1) | 1.38 | | indigo | 420 |
| (M)-(5) | 1.41 | | indigo | 436 |
| (M)-(10) | 1.43 | | indigo | 425 |
| (M)-(14) | 1.15 | | indigo | 484.5 |
| (N)-(1) | 1.45 | | indigo | 428.9 |
| (N)-(5) | 1.32 | | indigo | 444.9 |
| (N)-(10) | 1.45 | | indigo | 433.9 |
| (N)-(14) | 1.22 | | indigo | 493.4 |
| (O)-(1) | 1.35 | | indigo | 449 |
| (O)-(6) | 1.05 | | indigo | 512 |
| (O)-(9) | 1.00 | | indigo | 543 |

The dyes in the above Table are shown by the numerals in the above Table 1-A.

TABLE 3-A

| Dye | Color forming density | Fastness | Tone |
|---|---|---|---|
| 1 | 0.99 | x | indigo |
| 2 | 1.16 | Δ | indigo |
| 3 | 2.07 | x | indigo |
| 4 | 1.12 | Δ | indigo |
| 5 | 1.02 | x | violet |

The dyes in the above Table are as follows:
1: C.I. Disperse Blue 14
2: C.I. Disperse Blue 134
3: C.I. Solvent Blue 63
4: C.I. Disperse Blue 26
5: C.I. Disperse Violet 4

The color forming density in the above Tables 2-A and 3-A is a value measured by Densitometer RD-918 produced by Macbeth Co., U.S.A.

Adhesiveness was rated as ⊙ when the recorded image, after it had been left to stand in an atmosphere of 50° C. for a long time, was not changed in sharpness of the image, and a piece of white paper was not colored when the surface was rubbed with the white paper; as O when the sharpness was slightly lost, and the white paper was slightly colored; as Δ when sharpness was lost, and the white paper was colored; and x when the image became indistinct, and the white paper was remarkably colored.

EXAMPLE B-1

An amount of 1.75 parts of a compound represented by the following structural formula:

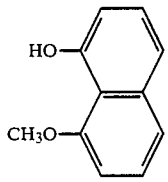

was dissolved in 200 parts of 95% ethanol, and to the resultant solution was added an aqueous solution of 5 parts of anhydrous sodium carbonate dissolved in 50 parts of water to make a mixed solution.

Next, the sulfate hydrate of a compound represented by the following structural formula:

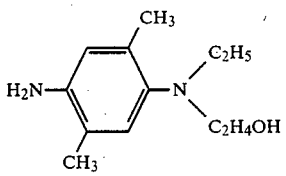

in an amount of 2.3 parts as calculated on the basis of the compound of the structural formula was dissolved in 50 parts of water, and the resultant solution was added to the above mixed solution. Then, after the mixture was thoroughly mixed, 12.5 parts of sodium hypochlorite solution was added gradually thereto. The mixture was stirred under this state for 15 minutes, filtered and washed with pure water. When the filtrate became neutral, it was dried and the product was dissolved in ethyl acetate and subjected to column purification by the use of ethyl acetate/heptane to obtain a dye of the following structural formula [(A)-(1) in the above Table 1-B].

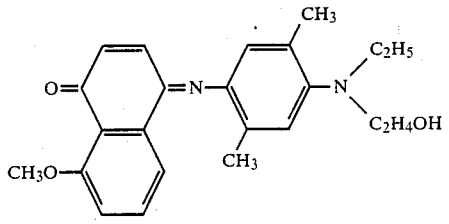

EXAMPLE B-2

According to the same method as in Example B-1, the dyes of the Examples in the above Table 1-B were obtained by varying the respective starting materials.

EXAMPLE B-3

An ink composition for formation of a dye carrying layer with the following composition was prepared and applied on a polyester terephthalate film with a thickness of 9 μm, the back surface of which had been subjected to a heat-resistant treatment, to a dried coating amount of 1.0 g/m². The coating was dried to obtain a heat transfer sheet of the present invention.

| | |
|---|---|
| Dye in the above TABLE 2 | 3 parts |
| Polyvinylbutyral resin | 4.5 parts |
| Methyl ethyl ketone | 46.25 parts |
| Toluene | 46.25 parts |

Next, by the use of a synthetic paper (Yupo FPG #150, produced by Oji Yuka), a coating liquid of the following composition was applied in a proportion of 10.0 g/m² on drying and dried at 100° C. for 30 minutes to obtain a transferable material.

| | |
|---|---|
| Polyester resin (Vylon 200, produced by Toyobo, Japan) | 11.5 parts |
| Vinyl chloride-vinyl acetate copolymer (VYHH, produced by UCC) | 5.0 parts |
| Amino-modified silicone (KF-393, produced by Shinetsu Kagaku Kogyo, Japan) | 1.2 parts |
| Epoxy-modified silicone (X-22-343, produced by Shinetsu Kagaku Kogyo, Japan) | 1.2 parts |
| Methyl ethyl ketone/toluene/cyclohexanone (weight ratio 4:4:2) | 102.0 parts |

The above heat transfer sheet of the present invention and the above transferable sheet were superposed on one another with the respective dye carrying layer and the dye receiving layer facing each other, and recording was performed with a thermal head from the back surface of the heat transfer sheet under the conditions of an application voltage of 10 V and a printing time of 4.0 msec. to obtain the results shown below in Table 2.

COMPARATIVE EXAMPLE B

By the use of the dye in Table 3-B shown below as the dye in Example B-3, and following otherwise the same procedure as in Example B-4, the results shown in Table 3-B below were obtained. However, the ink composition for formation of the dye carrying layer was made as shown below.

| | |
|---|---|
| Dye in Table 3-B shown below | 3 parts |

-continued

| | |
|---|---|
| Polyvinylbutyral resin | 4.5 parts |
| Methyl ethyl ketone | 46.25 parts |
| Toluene | 46.25 parts |

TABLE 2-B

| Dye | Color forming density | Fastness | Tone | Molecular weight |
|---|---|---|---|---|
| (A)-(1) | 1.40 | | indigo | 397 |
| (A)-(2) | 1.53 | | indigo | 386 |
| (A)-(3) | 1.52 | | indigo | 379 |
| (A)-(4) | 1.40 | | indigo | 407 |
| (A)-(5) | 1.32 | | indigo | 449 |
| (A)-(6) | 1.30 | | indigo | 456 |
| (A)-(7) | 1.42 | | indigo | 419 |
| (A)-(8) | 1.21 | | indigo | 430 |
| (A)-(9) | 1.18 | | indigo | 458 |
| (A)-(12) | 1.48 | | indigo | 407 |
| (A)-(13) | 1.38 | | indigo | 439 |
| (A)-(14) | 1.50 | | indigo | 398.5 |
| (B)-(1) | 1.41 | | indigo | 426 |
| (B)-(2) | 1.39 | | indigo | 412 |
| (B)-(4) | 1.36 | | indigo | 439 |
| (B)-(5) | 1.18 | | indigo | 481 |
| (B)-(7) | 1.30 | | indigo | 451 |
| (B)-(8) | 1.09 | | indigo | 462 |
| (B)-(9) | 1.07 | | indigo | 490 |
| (B)-(10) | 1.48 | | indigo | 409 |
| (B)-(13) | 1.21 | | indigo | 471 |
| (B)-(15) | 1.24 | | indigo | 469 |
| (C)-(1) | 1.33 | | indigo | 422 |
| (C)-(2) | 1.24 | | indigo | 468 |
| (C)-(4) | 1.28 | | indigo | 435 |
| (C)-(5) | 1.33 | | indigo | 447 |
| (C)-(7) | 1.31 | | indigo | 447 |
| (C)-(8) | 1.22 | | indigo | 458 |
| (C)-(9) | 1.02 | | indigo | 485.5 |
| (C)-(10) | 1.50 | | indigo | 405 |
| (C)-(13) | 1.23 | | indigo | 467 |
| (C)-(16) | 1.04 | | indigo | 506 |
| (D)-(1) | 1.30 | | indigo | 454 |
| (D)-(5) | 1.06 | | indigo | 507 |
| (D)-(10) | 1.43 | | indigo | 411 |
| (D)-(14) | 1.34 | | indigo | 458.5 |
| (E)-(2) | 1.41 | | indigo | 421 |
| (E)-(3) | 1.28 | | indigo | 470 |
| (E)-(4) | 1.30 | | indigo | 447 |
| (E)-(6) | 1.07 | | indigo | 507 |
| (E)-(7) | 1.26 | | indigo | 466 |
| (E)-(8) | 1.21 | | indigo | 475 |
| (E)-(9) | 1.01 | | indigo | 499 |
| (E)-(12) | 1.30 | | indigo | 448 |
| (E)-(13) | 1.08 | | indigo | 480 |
| (F)-(1) | 1.48 | | indigo | 410 |
| (F)-(2) | 1.50 | | indigo | 396 |
| (F)-(3) | 1.53 | | indigo | 395 |
| (F)-(4) | 1.42 | | indigo | 423 |
| (F)-(5) | 1.32 | | indigo | 465 |
| (F)-(6) | 1.08 | | indigo | 502 |
| (F)-(7) | 1.38 | | indigo | 435 |
| (F)-(8) | 1.16 | | indigo | 446 |
| (F)-(9) | 1.18 | | indigo | 474 |
| (F)-(12) | 1.41 | | indigo | 423 |
| (F)-(13) | 1.28 | | indigo | 455 |
| (F)-(15) | 1.33 | | indigo | 453 |
| (G)-(1) | 1.25 | | indigo | 458.9 |
| (G)-(2) | 1.32 | | indigo | 444.9 |
| (G)-(3) | 1.31 | | indigo | 443.9 |
| (G)-(4) | 1.26 | | indigo | 471.9 |
| (G)-(5) | 1.07 | | indigo | 513.9 |
| (G)-(6) | 1.90 | | indigo | 550.9 |
| (G)-(7) | 1.12 | | indigo | 483.9 |
| (G)-(8) | 0.91 | | indigo | 494.9 |
| (G)-(9) | 0.92 | | indigo | 522.9 |
| (G)-(12) | 1.21 | | indigo | 471.9 |
| (G)-(13) | 1.10 | | indigo | 503.9 |
| (G)-(16) | 0.93 | | indigo | 542.9 |
| (H)-(1) | 1.40 | | indigo | 430 |
| (H)-(2) | 1.44 | | indigo | 416 |
| (H)-(4) | 1.32 | | indigo | 443 |

TABLE 2-B-continued

| Dye | Color forming density | Fastness | Tone | Molecular weight |
|---|---|---|---|---|
| (H)-(5) | 0.94 | | indigo | 485 |
| (H)-(7) | 1.31 | | indigo | 455 |
| (H)-(8) | 1.20 | | indigo | 466 |
| (H)-(9) | 1.22 | | indigo | 468.5 |
| (H)-(12) | 1.35 | | indigo | 443 |
| (H)-(13) | 1.23 | | indigo | 475 |
| (I)-(1) | 1.30 | | indigo | 444.5 |
| (I)-(5) | 1.08 | | indigo | 499.5 |
| (I)-(10) | 1.32 | | indigo | 427.5 |
| (I)-(14) | 1.30 | | indigo | 449 |
| (J)-(1) | 1.37 | | indigo | 435 |
| (J)-(5) | 1.12 | | indigo | 490 |
| (J)-(10) | 1.42 | | indigo | 418 |
| (J)-(14) | 1.33 | | indigo | 439.5 |
| (K)-(1) | 1.55 | | indigo | 394 |
| (K)-(5) | 1.31 | | indigo | 449 |
| (K)-(10) | 1.61 | | indigo | 377 |
| (K)-(14) | 1.48 | | indigo | 398.5 |
| (K)-(16) | 1.21 | | indigo | 478 |
| (L)-(1) | 1.43 | | indigo | 426 |
| (L)-(5) | 1.07 | | indigo | 481 |
| (L)-(10) | 1.50 | | indigo | 409 |
| (L)-(14) | 1.14 | | indigo | 430.5 |
| (M)-(1) | 1.35 | | indigo | 422 |
| (M)-(5) | 1.24 | | indigo | 477 |
| (M)-(10) | 1.53 | | indigo | 405 |
| (M)-(14) | 1.38 | | indigo | 426.5 |
| (N)-(1) | 1.30 | | indigo | 454 |
| (N)-(5) | 1.11 | | indigo | 509 |
| (N)-(10) | 1.41 | | indigo | 437 |
| (N)-(14) | 1.24 | | indigo | 458.5 |

The dyes in the above Table are shown by the numerals in the above Table 1-B.

TABLE 3-B

| Dye | Color forming density | Fastness | Tone |
|---|---|---|---|
| 1 | 0.99 | x | indigo |
| 2 | 1.16 | Δ | indigo |
| 3 | 2.07 | x | indigo |
| 4 | 1.12 | Δ | indigo |
| 5 | 1.02 | x | violet |

The dyes in the above Table are as follows:

1: C.I. Disperse Blue 14
2: C.I. Disperse Blue 134
3: C.I. Solvent Blue 63
4: C.I. Disperse Blue 26
5: C.I. Disperse Violet 4

The color forming density in the above Tables 2-B and 3-B is a value measured by Densitometer RD-918 produced by Macbeth Co., U.S.A.

Adhesiveness was rated as ⊙ when the recorded image, after it had been left to stand in an atmosphere of 50° C. for a long time, was not changed in sharpness of the image, and a piece of white paper was not colored when it was used to rub the surface; as O when the sharpness is slightly lost, and the white paper was slightly colored; as Δ when sharpness was lost, and the white paper was colored; and x when the image became indistinct, and the white paper was remarkably colored.

EXAMPLE C-1

0.95 parts of phenol was dissolved in 200 parts of 95% ethanol, and to the resultant solution was added an aqueous solution of 5 parts of anhydrous sodium carbonate dissolved in 50 parts of water to make a mixed solution.

Next, the sulfate hydrate of a compound represented by the following structural formula:

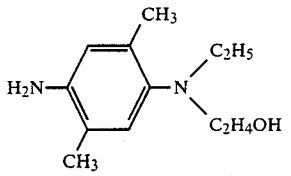

in an amount of 2.3 parts as calculated on the basis of the compound of the structural formula was dissolved in 50 parts of water, and the resultant solution was added to the above mixed solution Then, after the mixture was thoroughly mixed, 12.5 parts of sodium hypochlorite solution was added gradually thereto. The mixture was stirred under this state for 15 minutes, filtered and washed with pure water. When the filtrate became neutral, it was dried, and the product was dissolved in ethyl acetate and subjected to column purification by the use of ethyl acetate/heptane to obtain a dye of the following structural formula [(A)-(1) in the above Table 1-C].

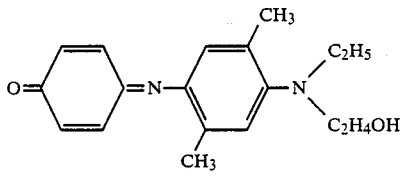

EXAMPLE C-2

According to the same method as in Example C-1, the dyes of the Examples in the above Table 1-C were obtained by varying their respective starting materials.

EXAMPLE C-3

An ink composition for formation of a dye carrying layer of the following composition was prepared and applied on a polyester terephthalate film with a thickness of 9 μm, the back surface of which had been subjected to a heat-resistant treatment, to a dried coating amount of 1.0 g/m². The coating was dried to obtain a heat transfer sheet of the present invention.

| | |
|---|---|
| Dye in the above Table 1-C | 3 parts |
| Polyvinylbutyral resin | 4.5 parts |
| Methyl ethyl ketone | 46.25 parts |
| Toluene | 46.25 parts |

Next, by the use of a synthetic paper (Yupo FPG #150, produced by Oji Yuka), a coating liquid of the following composition was applied in a proportion of 10.0 g/m² on drying and dried at 100° C. for 30 minutes to obtain a transferable material.

| | |
|---|---|
| Polyester resin (Vylon 200, produced by Toyobo, Japan) | 11.5 parts |
| Vinyl chloride-vinyl acetate copolymer (VYHH, produced by UCC) | 5.0 parts |
| Amino-modified silicone (KF-393, produced by Shinetsu Kagaku Kogyo, Japan) | 1.2 parts |
| Epoxy-modified silicone (X-22-343, produced by Shinetsu Kagaku Kogyo, Japan) | 1.2 parts |

-continued

| | |
|---|---|
| Methyl ethyl ketone/toluene/cyclohexanone (weight ratio 4:4:2) | 102.0 parts |

The above heat transfer sheet of the present invention and the above transferable sheet were superposed on one another with the respective dye carrying layer and the dye receiving layer facing each other, and recording was performed with a thermal head from the back surface of the heat transfer sheet under the conditions of an application voltage of 10 V and a printing time of 4.0 msec. to obtain the results shown below in Table 2.

COMPARATIVE EXAMPLE C

By the use of the dye in Table 3-C shown below as the dye in Example C-3, and following otherwise the same procedure as in Example C-4, the results shown in Table 3-C below were obtained. However, the ink composition for formation of dye carrying layer was made as shown below.

| | |
|---|---|
| Dye in Table 3-C shown below | 3 parts |
| Polybutyral resin | 4.5 parts |
| Methyl ethyl ketone | 46.25 parts |
| Toluene | 46.25 parts |

TABLE 2-C

| Dye | Color forming density | Fastness | Tone | Molecular weight |
|---|---|---|---|---|
| (A)-(1) | 2.05 | | indigo | 298 |
| (A)-(2) | 1.82 | | indigo | 325 |
| (A)-(3) | 1.90 | | indigo | 314 |
| (A)-(4) | 1.48 | | indigo | 405 |
| (A)-(5) | 1.68 | | indigo | 353 |
| (A)-(6) | 1.47 | | indigo | 377 |
| (A)-(7) | 1.38 | | indigo | 402 |
| (A)-(10) | 1.82 | | indigo | 326 |
| (A)-(11) | 1.98 | | indigo | 305 |
| (A)-(12) | 1.60 | | indigo | 377 |
| (B)-(1) | 1.82 | | indigo | 325 |
| (B)-(2) | 1.55 | | indigo | 364.5 |
| (B)-(3) | 1.76 | | indigo | 344 |
| (B)-(5) | 1.52 | | indigo | 385 |
| (B)-(6) | 1.30 | | indigo | 429 |
| (B)-(7) | 1.30 | | indigo | 424 |
| (B)-(8) | 1.72 | | indigo | 343 |
| (B)-(11) | 1.67 | | indigo | 358 |
| (B)-(13) | 1.62 | | indigo | 373 |
| (C)-(1) | 1.82 | | indigo | 326 |
| (C)-(2) | 1.55 | | indigo | 360.5 |
| (C)-(4) | 1.78 | | indigo | 340 |
| (C)-(5) | 1.59 | | indigo | 381 |
| (C)-(6) | 1.39 | | indigo | 425 |
| (C)-(7) | 1.30 | | indigo | 420 |
| (C)-(8) | 1.78 | | indigo | 339 |
| (C)-(11) | 1.70 | | indigo | 354 |
| (D)-(1) | 1.68 | | indigo | 358 |
| (D)-(3) | 1.62 | | indigo | 372 |
| (D)-(8) | 1.62 | | indigo | 371 |
| (D)-(12) | 1.42 | | indigo | 437 |
| (E)-(1) | 1.78 | | indigo | 339 |
| (E)-(2) | 1.61 | | indigo | 373.5 |
| (E)-(4) | 1.32 | | indigo | 446 |
| (E)-(5) | 1.52 | | indigo | 394 |
| (E)-(6) | 1.33 | | indigo | 438 |
| (E)-(7) | 1.34 | | indigo | 433 |
| (E)-(10) | 1.66 | | indigo | 367 |
| (E)-(11) | 1.66 | | indigo | 367 |
| (F)-(1) | 1.90 | | indigo | 314 |
| (F)-(2) | 1.68 | | indigo | 348.5 |
| (F)-(3) | 1.82 | | indigo | 328 |
| (F)-(4) | 1.43 | | indigo | 421 |
| (F)-(5) | 1.62 | | indigo | 369 |
| (F)-(6) | 1.40 | | indigo | 413 |

TABLE 2-C-continued

| Dye | Color forming density | Fastness | Tone | Molecular weight |
|---|---|---|---|---|
| (F)-(7) | 1.34 | | indigo | 408 |
| (F)-(10) | 1.74 | | indigo | 342 |
| (F)-(11) | 1.73 | | indigo | 342 |
| (F)-(13) | 1.68 | | indigo | 357 |
| (G)-(1) | 1.65 | | indigo | 363 |
| (G)-(2) | 1.50 | | indigo | 397.5 |
| (G)-(3) | 1.60 | | indigo | 377 |
| (G)-(4) | 1.22 | | indigo | 470 |
| (G)-(5) | 1.42 | | indigo | 418 |
| (G)-(6) | 1.23 | | indigo | 362 |
| (G)-(7) | 1.08 | | indigo | 457 |
| (G)-(10) | 1.48 | | indigo | 391 |
| (G)-(11) | 1.48 | | indigo | 391 |
| (H)-(1) | 1.84 | | indigo | 334.5 |
| (H)-(2) | 1.63 | | indigo | 369 |
| (H)-(3) | 1.68 | | indigo | 348.5 |
| (H)-(5) | 1.55 | | indigo | 389.5 |
| (H)-(6) | 1.33 | | indigo | 433.5 |
| (H)-(7) | 1.25 | | indigo | 428.5 |
| (H)-(10) | 1.64 | | indigo | 362.5 |
| (H)-(11) | 1.63 | | indigo | 362.5 |
| (I)-(1) | 1.68 | | indigo | 348.5 |
| (I)-(3) | 1.63 | | indigo | 362.5 |
| (I)-(8) | 1.64 | | indigo | 361.5 |
| (I)-(12) | 1.40 | | indigo | 427.5 |
| (J)-(1) | 1.82 | | indigo | 339 |
| (J)-(3) | 1.68 | | indigo | 353 |
| (J)-(8) | 1.68 | | indigo | 352 |
| (J)-(12) | 1.44 | | indigo | 418 |
| (K)-(1) | 1.08 | | indigo | 298 |
| (K)-(3) | 1.90 | | indigo | 312 |
| (K)-(8) | 1.90 | | indigo | 311 |
| (K)-(12) | 1.60 | | indigo | 377 |
| (L)-(1) | 1.81 | | indigo | 330 |
| (L)-(3) | 1.74 | | indigo | 344 |
| (L)-(8) | 1.73 | | indigo | 343 |
| (L)-(12) | 1.45 | | indigo | 409 |
| (M)-(1) | 1.85 | | indigo | 326 |
| (M)-(3) | 1.74 | | indigo | 340 |
| (M)-(8) | 1.74 | | indigo | 339 |
| (M)-(12) | 1.48 | | indigo | 405 |
| (N)-(1) | 1.72 | | indigo | 358 |
| (N)-(3) | 1.60 | | indigo | 372 |
| (N)-(8) | 1.60 | | indigo | 371 |
| (N)-(12) | 1.32 | | indigo | 437 |

The dyes in the above Table are shown by the numerals in the above Table 1-C.

TABLE 3-C

| Dye | Color forming density | Fastness | Tone |
|---|---|---|---|
| 1 | 0.99 | × | indigo |
| 2 | 1.16 | Δ | indigo |
| 3 | 2.07 | × | indigo |
| 4 | 1.12 | Δ | indigo |
| 5 | 1.02 | × | violet |

The dyes in the above Table are as follows:

1: C.I. Disperse Blue 14
2: C.I. Disperse Blue 134
3: C.I. Solvent Blue 63
4: C.I. Disperse Blue 26
5: C.I. Disperse Violet 4

The color forming density in the above Tables 2-C and 3-C is a value measured by Densitometer RD-918 produced by Macbeth Co., U.S.A.

Adhesiveness was rated as ◎ when the recorded image, after it had been left to stand in an atmosphere of 50° C. for a long time, was not changed in sharpness of the image, and a piece of white paper was not colored when it was rubbed on the surface; as ○ when the sharpness is slightly lost, and the white paper is slightly colored; as Δ when the sharpness is lost, and the white paper is colored; and x when the image became indistinct, and the white paper was remarkably colored.

INDUSTRIAL APPLICABILITY

The dye and the heat transfer sheet according to the present invention can be used widely as materials for heat transfer sheets for carrying out image formation according to the sublimation transfer method.

We claim:

1. A heat transfer sheet comprising a substrate sheet and a dye carrying layer formed on one surface of said substrate sheet, said dye carrying layer comprising a dye and a binder, said dye being represented by the following formula:

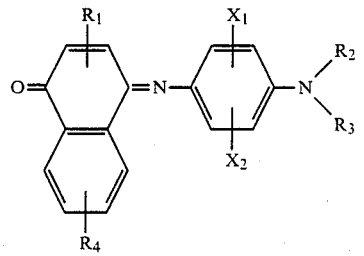

wherein each of $X_1$ and $X_2$ represents hydrogen, an alkyl group, alkoxy group, acylamino group, aminocarbonyl group or a halogen; $R_1$ represents a substituent selected from hydrogen, one or more alkyl groups, alkoxy groups, halogens, hydroxyl groups, amino groups, alkylamino groups, acylamino groups, sulfonylamino groups, aminocarbonyl groups, aryl groups, arylalkyl groups or nitro groups; each of $R_2$ and $R_3$ represents an alkyl group or a substituted alkyl group; and $R_4$ represents a substituent selected from one or more alkyl groups, alkoxy groups, halogens, hydroxyl groups, amino groups, alkylamino groups, acylamino groups, sulfonylamino groups, aminocarbonyl groups, aryl groups, arylalkyl groups or nitro groups.

* * * * *